US009806393B2

(12) United States Patent
Kildal et al.

(10) Patent No.: US 9,806,393 B2
(45) Date of Patent: Oct. 31, 2017

(54) GAP WAVEGUIDE STRUCTURES FOR THZ APPLICATIONS

(71) Applicant: GAPWAVES AB, Göteborg (SE)

(72) Inventors: Per-Simon Kildal, Pixbo (SE); Sjoerd Haasl, Årsta (SE); Peter Enoksson, Stockholm (SE)

(73) Assignee: GAPWAVES AB, Gothenburg (SE)

( * ) Notice: Subject to any disclaimer, the term of this patent is extended or adjusted under 35 U.S.C. 154(b) by 0 days.

(21) Appl. No.: 14/409,344

(22) PCT Filed: Jun. 18, 2013

(86) PCT No.: PCT/EP2013/062604

§ 371 (c)(1),
(2) Date: Dec. 18, 2014

(87) PCT Pub. No.: WO2013/189919

PCT Pub. Date: Dec. 27, 2013

(65) Prior Publication Data

US 2015/0194718 A1 Jul. 9, 2015

Related U.S. Application Data

(60) Provisional application No. 61/661,252, filed on Jun. 18, 2012.

(51) Int. Cl.
*H01P 5/12* (2006.01)
*H01P 3/12* (2006.01)
(Continued)

(52) U.S. Cl.
CPC ..... *H01P 3/12* (2013.01); *H01P 1/207* (2013.01); *H01P 5/12* (2013.01); *H01P 11/002* (2013.01);
(Continued)

(58) Field of Classification Search
CPC .... H01P 3/12; H01P 5/12; H01P 1/207; H01P 11/002; H01P 11/007
USPC ..... 333/137
See application file for complete search history.

(56) References Cited

U.S. PATENT DOCUMENTS 5,350,499 A * 9/1994 Shibaike ..... H01J 37/3056 204/192.34
7,420,442 B1 9/2008 Forman
8,451,189 B1 * 5/2013 Fluhler ..... H01Q 15/0086 343/756
(Continued)

OTHER PUBLICATIONS

A. A, Ayon, K. S Chen, K.A. Lohner, S.M Spearing, H.H Sawing and M. A. Schmidt, "Deeo Reactive Ion Etching of Silicon", 1998 , Dept. of Electrical Engineering and Computer Science, Dept. of Aeronautics and Astronautics, Massachusetts Insitute of Technology, 15-1-15-11.*
(Continued)

*Primary Examiner* — Robert Pascal
*Assistant Examiner* — Kimberly Y Glenn
(74) *Attorney, Agent, or Firm* — Buchanan Ingersoll & Rooney P.C.

(57) ABSTRACT

A microwave/millimeter device having a narrow gap between two parallel surfaces of conducting material by using a texture or multilayer structure on one of the surfaces is disclosed. The fields are mainly present inside the gap, and not in the texture or layer structure itself, so the losses are small. The microwave/millimeter wave device further includes one or more conducting elements, such as a metallized ridge or a groove in one of the two surfaces, or a metal strip located in a multilayer structure between the two surfaces. The waves propagate along the conducting elements. At least one of the surfaces is provided with means to prohibit the waves from propagating in other directions between them than along the ridge, groove or strip. At very high frequency, the gap waveguides and gap lines may be realized inside an IC package or inside the chip itself.

21 Claims, 6 Drawing Sheets

(51) Int. Cl.
*H01P 11/00* (2006.01)
*H01P 1/207* (2006.01)

(52) U.S. Cl.
CPC ..... *H01P 11/007* (2013.01); *Y10T 29/49016* (2015.01)

(56) References Cited

U.S. PATENT DOCUMENTS

2009/0040132 A1* 2/2009 Sridhar ..... H01Q 15/0086 343/911 R
2009/0245146 A1* 10/2009 Gummalla ..... H01Q 1/2283 370/281
2011/0181373 A1 7/2011 Kildal
2012/0154234 A1* 6/2012 Geiler ..... H01Q 15/008 343/787
2012/0161600 A1* 6/2012 Norris ..... B81C 99/009 313/11
2012/0326944 A1* 12/2012 Choi ..... B82Y 20/00 343/909

OTHER PUBLICATIONS

International Search Report (PCT/ISA/210) dated Oct. 14, 2013, by the European Patent Office as the International Searching Authority for International Application No. PCT/EP2013/062604.

Written Opinion (PCT/ISA/237) dated Oct. 14, 2013, by the European Patent Office as the International Searching Authority for International Application No. PCT/EP2013/062604.

S. Rahiminejad et al., "Design of Micromachined Ridge Gap Waveguides for Millimeter-Wave Applications", Procedia Engineering, vol. 25, Sep. 7, 2011, pp. 519-522, XP-028436587.

Elena Pucci et al., "New Microstrip Gap Waveguide on Mushroom-Type EBG for Packaging of Microwave Components", IEEE Microwave and Wireless Components Letters, vol. 22. No. 3, Mar. 2012, pp. 129-131, XP-011433789.

Per-Simon Kildal, "Three Metamaterial-Based Gap Waveguides Between Parallel Metal Plates for MM/SUBMM Waves", 3rd European Conference on Antennas and Propagation, Mar. 23-27, 2009, pp. 28-32, XP-031469742.

Per-Simon Kildal et al., "The Gap Waveguide as a Metamaterial-Based Electromagnetic Packaging Technology Enabling Integration of MMICs and Antennas Up to THz", Antennas and Propagation, Proceedings of the 5th European Conference on, IEEE., Apr. 11, 2011, pp. 3715-3718, XP-031878087.

Per-Simon Kildal et al. "Wideband, Lowloss, Low-Cost, QUASI-TEM Metamaterial-Based Local Waveguides in Air Gaps Between Parallel Metal Plates", Electromagnetics in Advanced Applications, Sep. 14, 2009, pp. 588-591, XP-031559822.

* cited by examiner

GAP WAVEGUIDE STRUCTURES FOR THZ APPLICATIONS

FIELD OF THE INVENTION

The present invention is related to a microwave/millimeter device for very high frequencies, using gap waveguide technology, and a method for producing such devices.

BACKGROUND

For microwave applications, solid rectangular waveguides and coaxial transmission lines are used due to their low losses at high frequencies. However, when scaling up in frequency and down in physical feature size, they experience some practical problems when integrated in a high-frequency system. Other waveguides have been introduced but often require electrically conductive sidewalls and good alignment. Even though some structures do not require solid walls they still need electrical contact between separately manufactured pieces. Traditional machining techniques for metal waveguides operating at millimeter-wave frequencies, specifically above 100 GHz, are very complicated and costly. Also, when realized as components and manufactured in two blocks, it is difficult to achieve the low loss and high Q-values at high frequencies. The reason is usually due to the field leakage through the tiny gaps, originating due to manufacturing imperfections or metal deformations due to thermal expansion, of two split blocks.

Apart from these manufacturing issues at high frequency, the integration of the active microwave electronic circuitry with a metal waveguide at high frequency is not very easy and often challenges the engineers. Today's planar monolithic microwave integrated circuits (MMICs) are incompatible with non-planar metal waveguides and require the use of different transitions, which adds more complexity in the overall system. This is e.g. discussed in P.-S. Kildal, E. Alfonso, A. Valero-Nogueira, and E. Rajo-Iglesias "Local metamaterial-based waveguides in gaps between parallel metal plates", IEEE Antennas and Wireless Propagation letters (AWPL), Vol. 8: pp. 84-87, 2009.

On the other hand, microstrip and coplanar waveguide lines are the most representative planar transmission lines and these are robust, low-cost solutions which are very suitable for integrating active microwave components on circuit boards. But both these lines suffer from high insertion loss in the millimeter wave frequency spectrum due to the presence of lossy dielectric material. Apart from this, the coupling between the substrate mode and the desired mode is very crucial beyond a critical frequency. So, despite many attractive properties of the existing transmission lines, their applications in the millimeter-wave frequency range are still critical and not immune to problems.

A new waveguide technology, called ridge gap waveguide has been presented in the article by P-S Kildal et al discussed above, and is also disclosed in US 2011/0181373 A1. This technology is based on local wave phenomena appearing along the ridges of corrugations in parallel-plate waveguides. This is further discussed in Valero-Nogueira, E. Alfonso, J. I. Herranz, P.-S. Kildal "Experimental demonstration of local quasi-TEM gap modes in single-hard-wall waveguides", IEEE Microwave and Wireless Components Letters 19 (2009) 536-538.

The ridge gap waveguide itself was demonstrated between 10 and 20 GHz and realized using conventional fabrication methods. See e.g. Valero-Nogueira, E. Alfonso, J. I. Herranz, P.-S. Kildal "Experimental demonstration of local quasi-TEM gap modes in single-hard-wall waveguides", IEEE Microwave and Wireless Components Letters 19 (2009) 536-538.

The structure uses metamaterial surfaces in the form of metal pins to create a parallel-plate stop band, thereby confining the wave to metal ridges in between the pins. See e.g. M. Silveirinha, C. Fernandes, J. Costa, "Electromagnetic characterization of textured surfaces formed by metallic pins", IEEE Transactions on Antennas and Propagation 56 (2008) 405-415. Metamaterials are artificial materials engineered to have properties that may not be found in nature. Metamaterials usually gain their properties from structure rather than composition, using small inhomogeneities to create effective macroscopic behavior. There is no need for electrically conducting sidewalls or accurate alignment between the two parallel metal plates. The stop band can also be designed using other periodic structures than pins. See e.g. E. Rajo-Iglesias, P.-S. Kildal, "Numerical studies of bandwidth of parallel plate cut-off realized by bed of nails, corrugations and mushroom-type EBG for use in gap waveguides", IET Microwaves, Antennas & Propagation 5 (2011) 282-289.

The initial study of the newly proposed gap waveguide technology shows that this new technology has much lower loss than microstrip lines or coplanar waveguides and is also much more flexible and easy to manufacture than the conventional metal waveguides. This newly proposed microwave solution based on gap waveguide technology thus gives a very good trade-off between the two opposing criteria of low-loss and manufacturing flexibility. Also, this gap waveguide has the property of suppressing the cavity modes and unwanted propagation within a microstrip circuit over a significant bandwidth and is proposed as a packaging solution. See e.g. E. Rajo-Iglesias, A. Uz Zaman, P.-S. Kildal, "Parallel plate cavity mode suppression in microstrip circuit packages using a lid of nails", IEEE Microwave and Wireless Components Letters 20 (2009) 31-33 and A. Uz Zaman, J. Yang, P.-S. Kildal, "Using lid of pins for packaging of microstrip board for descrambling the ports of eleven antenna for radio telescope applications", IEEE Antennas and Propagation Society International Symposium, 2010, pp. 1-4.

Despite their advantage over rectangular waveguides when it comes to assembly, these waveguides are very challenging to produce for frequencies above 100 GHz due to the small dimensions of the pins.

There is therefore a need for an improved and/or more cost-efficient manufacturing method for microwave/millimeter wave devices of the above-discussed type.

SUMMARY OF THE INVENTION

The object of the present invention is to provide improved and/or more cost-efficient microwave/millimeter wave devices of the above-discussed type, and a manufacturing method for such devices.

This object is achieved by means of a method and a microwave/millimeter wave device as defined in the appended claims.

According to a first aspect of the present invention, there is provided a scalable production method for fabrication of a microwave/millimeter wave device, such as an entire or part of an electromagnetic wave device, shielding of an electromagnetic wave device, or a package of an electromagnetic wave device, said microwave/millimeter wave device operating at frequencies in the entire range of or one or more subranges of the frequency range between 1 GHz and 100 THz, and comprising the step of providing a metamaterial on a surface of said microwave/millimeter wave device.

Metamaterials are in this context generally to be understood as a material engineered to a quasi-periodic pattern, and preferably a periodic pattern, to have properties obtained from the composition, such as precise shape, geometry, size and orientation, by incorporating structural elements of sub-wavelength sizes, i.e. features that are smaller than the wavelength of the waves they affect. The metamaterial preferably acts as a perfect magnetic conductor (PMC) within an operating frequency band, thereby functioning as a stop band stopping wave propagation inside a gap. The metamaterial is preferably provided in the form of posts, nails, pillars, patches or other forms extending in a quasi-periodic or periodic pattern from a surface. A particularly preferred design is pillars/posts having a mushroom-shape or inverted-pyramid-shape, i.e. having a smaller cross-sectional dimension at the end connected or integrated with the surface, and a larger cross-sectional dimension at the opposite end.

In the context of the present application, the term "microwave/millimeter wave device" is used to denominate any type of device and structure capable of transmitting, transferring, guiding and controlling the propagation of electromagnetic waves, particularly at high frequencies where the dimensions of the device or its mechanical details are of the same order of magnitude as the wavelength, such as waveguides, transmission lines, waveguide circuits or transmission line circuits. In the following, the present invention will be discussed in relation to various embodiments, such as waveguides, transmission lines, waveguide circuits or transmission line circuits. However, it is to be appreciated by someone skilled in the art that specific advantageous features and advantages discussed in relation to any of these embodiments are also applicable to the other embodiments.

By the use of micromachining, the fabrication of devices of this type, such as ridge gap waveguides and other ridge gap devices, become possible to produce cost-efficiently and in a scalable production for ranges above 1 GHz, and specifically above 100 GHz, and even more preferred above 1 THz. This enables efficient use of THz waves for various applications. For example, THz waves are useable for molecule detection, etc.

The microwave/millimeter device preferably has a narrow gap between two parallel surfaces of conducting material by using a texture or multilayer structure on one of the surfaces. The fields are mainly present inside the gap, and not in the texture or layer structure itself, so the losses are small. The microwave/millimeter wave device further comprises one or more conducting elements, such as a metallized ridge or a groove in one of the two surfaces, or a metal strip located in a multilayer structure between the two surfaces. The waves propagate along the conducting elements. At least one of the surfaces is provided with means to prohibit the waves from propagating in other directions between them than along the ridge, groove or strip. At very high frequency, the gap waveguides and gap lines may be realized inside an IC package or inside the chip itself.

As discussed above, conventional machining such as, but not limited to: drilling, milling and sawing, cannot define the structures with the precision required of devices above 1 GHz, and in particular above 100 GHz, such as in the range between 1 GHz and 100 THz, and in particular in the range between 100 GHz and 10 THz.

To obtain the high precision required, is has been found by the present inventors that microsystem manufacturing methods, such as deep reactive etching, can cost-efficiently be used to define the structures with high precision. Alternative fabrication methods such as injection molding or other micromolding process may also be used. It has also been found that a metal layer can cover non-conducting and semi-conducting surfaces efficiently and with a very good result.

The microwave/millimeter wave device is preferably based on the gap waveguide technology as disclosed in US 2011/0181373, said document hereby being incorporated in its entirety by reference.

Specifically, the microwave/millimeter wave device preferably comprises two opposing surfaces of conducting material arranged to form a narrow gap there between, wherein at least one of the surfaces is provided with at least one conducting element, such as a conducting ridge provided on the surface, a groove with conducting walls provided on the surface, or a conducting strip arranged within a multilayer structure of the surface, and wherein at least one of the surfaces is provided with said metamaterial, thereby stopping wave propagation in other directions inside the gap than along said conducting element.

The waveguide is defined by one of the surfaces and either a metal ridge (ridge gap waveguide) or a groove (groove gap waveguide) in the other surface, and the transmission line is defined by one of the surfaces and a metal strip located inside the gap between the two surfaces (microstrip gap line). The waves propagate along the ridge, groove and strip, respectively. No metal connections between the two metal surfaces are needed. At least one of the surfaces is provided with means, such as metamaterial, to prohibit the waves from propagating in other directions between them than along the ridge, groove or strip, e.g. by using a texture or structure in the metal surface itself or a periodic metal layer in the multilayer structure. The texture or structure will often be periodic or quasi-periodic and designed to interact with the waves in such a way that they work macroscopically as artificial magnetic conductors (AMC), electromagnetic bandgap (EBG) surfaces or soft surface. There may be a solid metal wall along the rim of at least one of the two metal surfaces. This wall can be used to keep the surfaces in stable position relative to each other with a well defined and small gap between them. This wall can be located quite close to the circuits without affecting the performance, and it will even provide a good packaging solution for integration of active integrated circuits. At very high frequency, the gap wave guides and gap lines may be realized inside an IC package or inside the chip itself.

The basic geometry of the present invention comprises two parallel conducting surfaces. These surfaces can be the surfaces of two metal bulks, but they can also be made of other types of materials having a metalized surface. They can also be made of other materials with good electric conductivity. The two surfaces can be plane or curved, but they are in both cases separated by a very small distance, a gap, and the transmission line circuits and waveguide circuits are formed inside this gap between the two surfaces. The gap is typically filled with air, but it can also be fully or partly dielectric-filled, and its size is typically smaller than 0.25 wavelengths, effectively.

By this texture or multilayer structure, preferably in the form of a metamaterial, it is possible to control the wave propagation in the gap between the two surfaces so that it follows specific paths, appearing as transmission lines or waveguides inside the gap, thus gap transmission lines and gap waveguides. By connecting together or integrating gap waveguides (or transmission lines) of different lengths, directions and characteristic impedances, and by controlling the coupling between parallel gap waveguides (or transmission lines), it is possible to realize waveguide (or transmission line) components and complete waveguide (or transmission line) circuits between the two parallel conducting surfaces, in a similar manner to how such circuits are realized with conventional microstrip lines and cylindrical, rectangular or coaxial waveguides.

In the method, the step of providing said metamaterial on said surface of the microwave/millimeter wave device may involve a silicon microfabrication method. The silicon microfabrication method is preferably a deep reactive ion etching.

The step of providing said metamaterial on said surface of the microwave/millimeter wave device may additionally or alternatively involve the use of carbon nanofibers or carbon nanotubes.

The step of providing said metamaterial on said surface of the microwave/millimeter wave device may additionally or alternatively involve the use of at least one polymer to fabricate a high-resolution structure, and subsequently metalizing the high-resolution structure. The at least one polymer may comprise a patterned photosensitive high-aspect ratio polymer, such as SU-8. Further, at least one of said at least one polymers may advantageously be formed by a at least one of a micromolding process, such as injection molding, and hot embossing.

The metallization is preferably applied by at least one of sputtering, evaporation and chemical vapor deposition. The metallization may subsequently be improved by at least one of electroplating and electroless plating.

The step of providing said metamaterial on said surface of the microwave/millimeter wave device may also involve a Lithographie, Galvanoformung, Abformung (Lithography, Electroplating and Molding, LIGA) process.

Further, the step of providing said metamaterial on said surface of the microwave/millimeter wave device may involve the steps of sputtering of a metal layer on the surface, such as 0.5 um layer of Al, spinning of a photoresist layer thereon, developing the photoresist layer, etching of the exposed metal, e.g. using deep reactive ion etching. After the Al and remaining resist has been stripped, the method may further comprise sputtering of gold as a seed layer and electroplating.

At least one part of said microwave/millimeter wave device may be fabricated using conventional machining technologies and materials, such as printed circuit board technology, metal machining or metalized non-metals.

Further, at least one part of said microwave/millimeter wave device may be fabricated using freefoiming or 3D forming in metals or other conducting material or metalized non-metals. The metallization may be applied by at least one of sputtering, evaporation and chemical vapor deposition. The metallization may further be improved by electroplating or electroless plating.

The metamaterial preferably acts as a perfect magnetic conductor at a certain frequency range.

Preferably, one fabricated part of the microwave/millimeter wave device is a lid. The lid is hereby arrangeable over a second part, e.g. being provided with said metamaterial. The lid is preferably connected to the other part around an outer rim. The connection is preferably formed by means of at least one of silicon fusion bonding, eutectic bonding, anodic bonding and adhesive bonding.

The metamaterial may be formed on a flange on said microwave/millimeter wave device, thereby providing improved connectability to other devices etc.

Preferably, the microwave/millimeter wave device is at least one of: a waveguide, a transmission line, a waveguide circuit, a transmission line circuit, a resonator/filter, a flange, e.g. for connecting to rectangular waveguides, a splitter, a shielding and a packaging.

According to another aspect of the present invention, there is provided a microwave/millimeter wave device, such as an electromagnetic wave device, a shielding of an electromagnetic wave devices or a package of electromagnetic wave devises, said microwave/millimeter wave device operating at frequencies in the entire range of or one or more subranges of the frequency range between 1 GHz and 100 THz, wherein the microwave/millimeter wave device comprises a metmaterial arranged on at least one surface thereof, said metamaterial being based on mushroom-shaped or inverted-pyramid-shaped pillars.

Hereby, similar advantages and specific features as discussed above in relation to the first embodiment are obtainable and realizable.

The metamaterial preferably acts as a perfect magnetic conductor in the operating frequency range.

As discussed above, the microwave/millimeter wave device is preferably based on the gap waveguide technology as disclosed in US 2011/0181373, said document hereby being incorporated in its entirety by reference. In particular, the microwave/millimeter wave device preferably comprises two opposing surfaces of conducting material arranged to form a narrow gap there between, wherein at least one of the surfaces is provided with at least one conducting element, such as a conducting ridge provided on the surface, a groove with conducting walls provided on the surface, or a conducting strip arranged within a multilayer structure of the surface, and wherein at least one of the surfaces is provided with said metamaterial, thereby stopping wave propagation in other directions inside the gap than along said conducting element.

The metamaterial may be provided on a flange of said microwave/millimeter wave device. By means of such flanges, there is provided a way of connecting together waveguides or transmission lines of different passive and active high-frequency circuits that removes or at least strongly reduces problems related to radiation from the point of connection, shielding to avoid that unwanted external fields enters into the waveguide or transmission lines, and matching of the characteristic impedance of the two opposing transmission lines or waveguides. Further, the connection becomes less sensitive to tolerances, in particular since no metal connections between such flanges are needed for transmission purposes. The flanges are preferably arranged to extend out from the ends of waveguides.

Preferably, the microwave/millimeter wave device is at least one of: a waveguide, a transmission line, a waveguide circuit, a transmission line circuit, a resonator/filter, a flange, e.g. for connecting to rectangular waveguides, a splitter, a shielding and a packaging.

According to still another aspect of the present invention, there is provided a flange comprising a metamaterial for use with electromagnetic wave devices.

According to a yet another aspect of the present invention, there is provided an electromagnetic wave devise having a metamaterial arranged on a surface, said metamaterial comprising arbitrarily shaped pillars, patches or other forms.

Hereby, similar advantages and specific features as discussed above in relation to the first embodiment are obtainable and realizable.

Further advantages and features of the present invention will become apparent from the following detailed description of specific embodiments.

DRAWINGS

The invention will now be discussed in more detail by means of embodiments, and with reference to the enclosed drawings, on which:

FIG. 1 shows a two-way power divider or combiner as an example of a component that is an embodiment of the invention. The component is realized by using ridge gap waveguides between metal surfaces. The upper metal surface is shown in a lifted position to reveal the texture on the lower surface.

FIGS. 2*a* and 2*b* show a cut along the input line of a 90 deg bend in a ridge gap waveguide according to an embodiment of the invention, both in a perspective view (2*a*), and in a cross sectional view (2*b*).

FIGS. 3, 4, and 5 show the cross sections of three examples of groove gap waveguides according to embodiments of the invention.

FIGS. 6*a-e* shows various stages in a process plan as an example of a fabrication process that is an embodiment of the invention.

FIGS. 7*a* and 7*b* show exemplary embodiments according to the present invention, wherein FIG. 7*a* is a ridge gap waveguide, and FIG. 7*b* is a ridge gap resonator.

FIG. 9 is a design of the pin-flange surface, and FIG. 10 is a pin-flange-adapter prototype.

DETAILED DESCRIPTION OF THE FIGURES

In the following, the present invention will be discussed in relation to these types of embodiments, and it is to be appreciated by someone skilled in the art that specific advantageous features and advantages discussed in relation to any of these embodiments are also applicable to the other embodiments.

Figure 1:
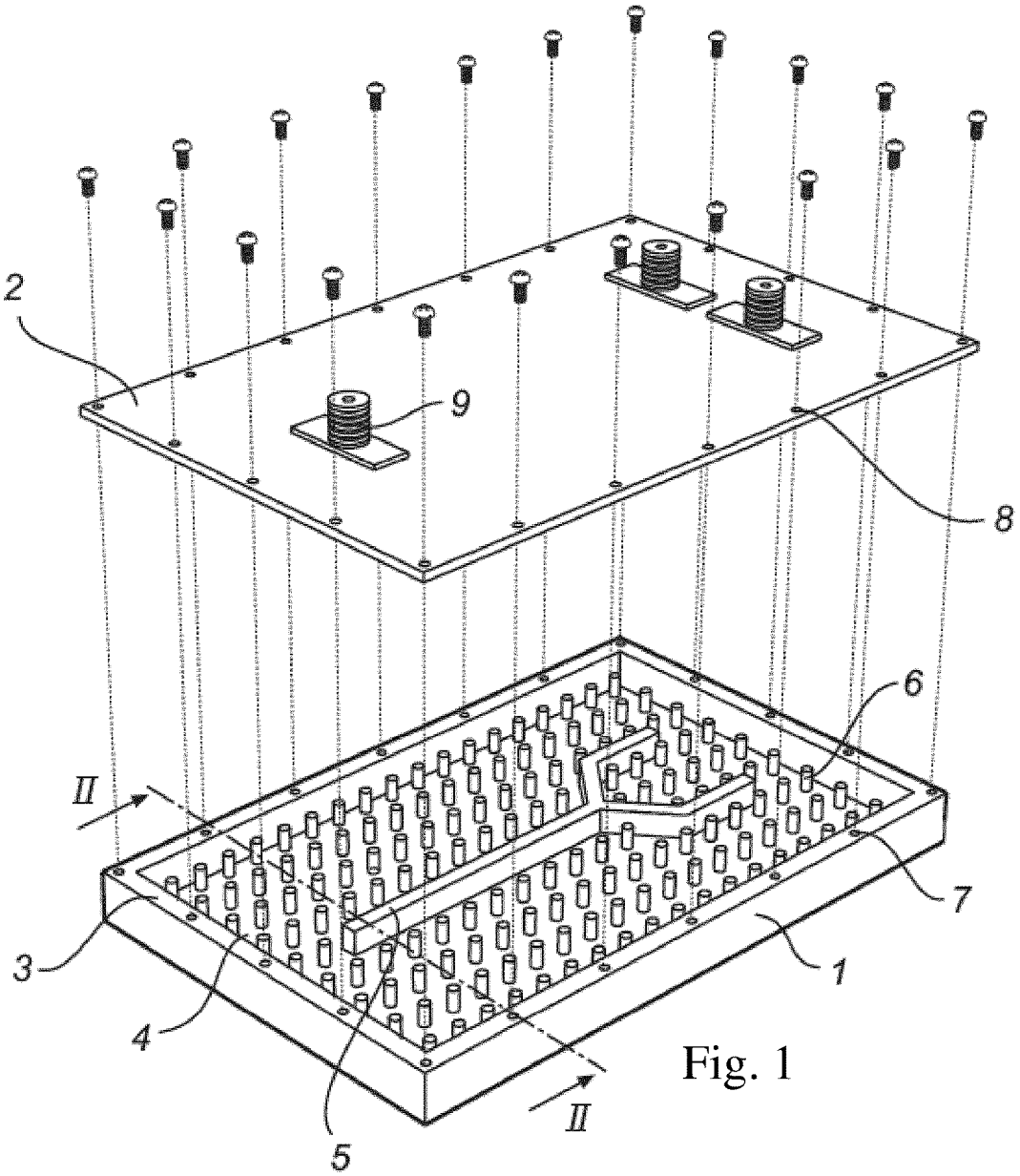

FIG. 1 shows a two-way power divider or combiner as an example of a component that is an embodiment of the invention. There are two metalized pieces providing the upper 1 and lower 2 conducting surfaces. The upper surface is smooth, but the lower surface is structured. Surrounding the structure/texture, forming a metamaterial, there is a surrounding rim 3 to which the upper surface can be fixed, and a region which is lower than the rim and thereby provides a gap 4 between the upper and lower surfaces when the upper surface is mounted. The metalized ridge 5 is forming a two-armed fork, and around the ridge there are metalized posts 6 providing cut-off conditions for all waves propagating between the lower and upper surfaces except the desired waves along the ridge 5. The metalized posts here forms a metamaterial, as discussed in the foregoing. The posts work similar to a perfect magnetic conductor (PMC) within the operating frequency band. There are screw holes 8 in the upper metal piece that is used to fix it to the metal rim 3 of the lower metal piece, and there are matching screw holes 7 in this rim. The mounting is shown with screws, but other methods, more common in micromechanical fabrication can be used, such as silicon fusion bonding, eutectic bonding, anodic bonding, adhesive bonding.

Figure 2A:
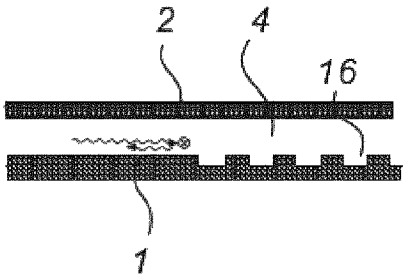
Figure 2B:
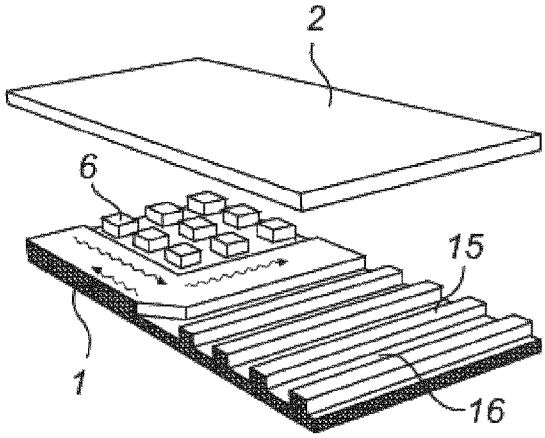

FIGS. 2*a* and 2*b* show how the wave stop surface is located to stop waves approaching the 90 deg bend from continuing to propagate straight forward. The waves are indicated as wave shaped arrows pointing in the propagation direction. The lengths of the arrows indicate the amplitudes of the different waves. The approaching wave may instead either be reflected (undesired) or turn left (desired). The desired turn of the wave can be achieved by properly cutting the corner of the bend as shown.

Figure 3:
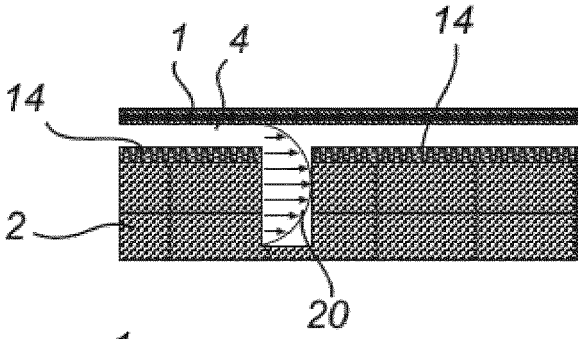
Figure 4:
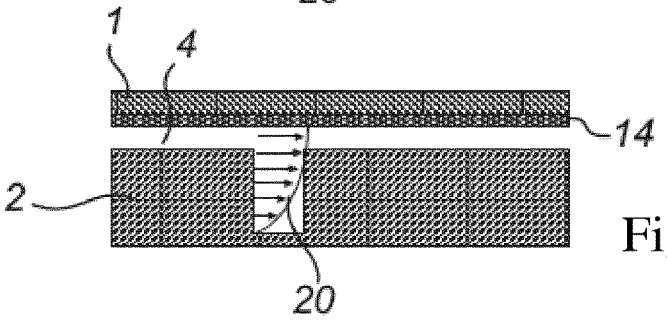
Figure 5:
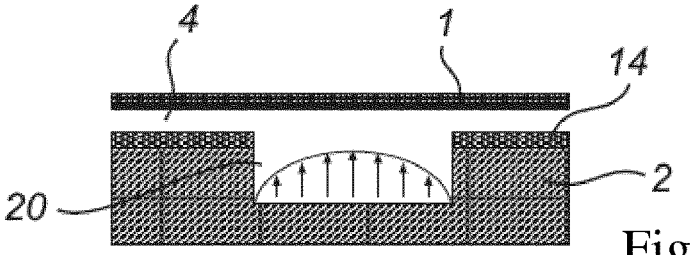

FIGS. 3, 4 and 5 show different groove gap waveguides, but it may also be in the upper surface, or there may be two opposing grooves in both surfaces. The groove 20 is provided in the lower surface. The groove supports a horizontally polarized wave in FIGS. 3 and 4, provided the distance from the top surface to the bottom of the groove is more than typically 0.5 wavelengths in FIG. 3, and 0.25 wavelengths in FIG. 4. The groove in FIG. 5 supports a vertically polarized wave when the width of the groove is larger than 0.5 wavelengths. The widths of the grooves in FIGS. 3 and 4 should preferably be narrower than 0.5 wavelengths, and the distance from the bottom of the groove in FIG. 5 to the upper surface should preferably be smaller than effectively 0.5 wavelengths (may be even smaller depending on gap size), both in order to ensure single-mode propagation. The lower surfaces in FIGS. 3 and 5, and the upper surface in FIG. 4 are provided with a wave stop surface 14. The wave stop surface can have any realization that prevents the wave from leaking out of the groove 20.

Figure 6:
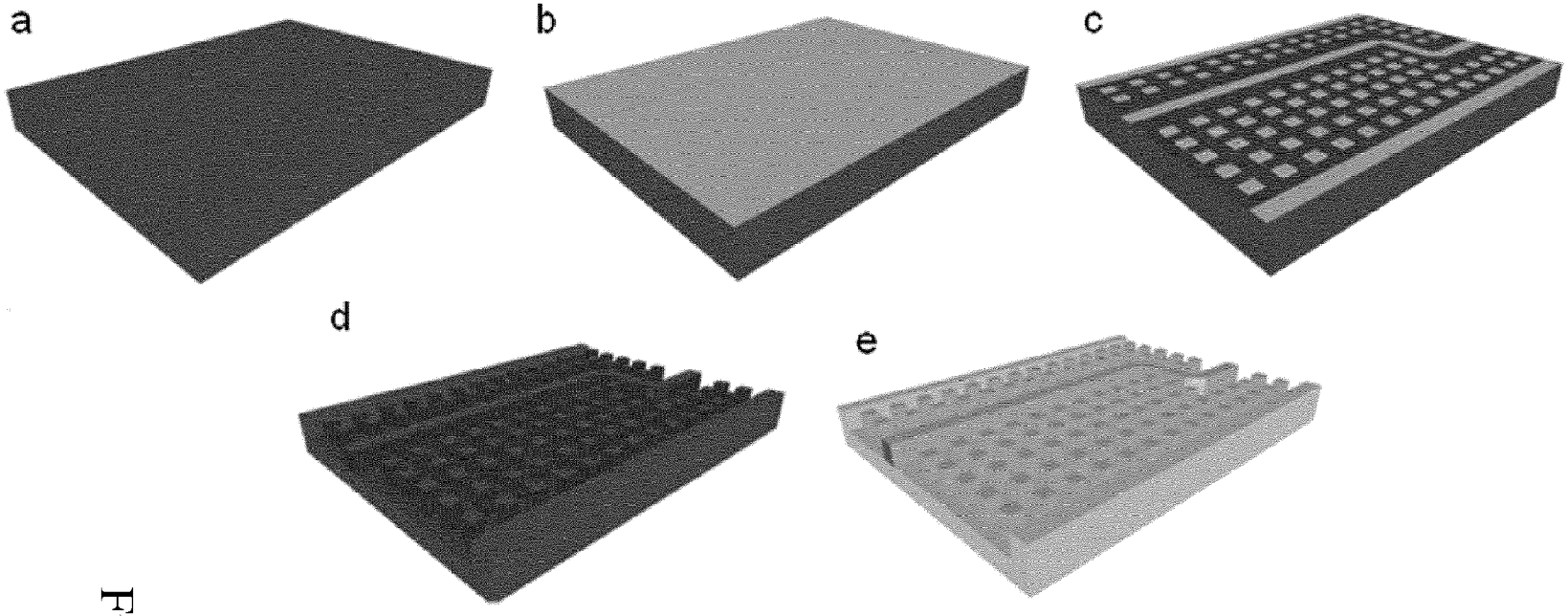

FIG. 6 shows various sequential stages in a process plan as an example of a fabrication process that is an embodiment of the invention. In a first step, illustrated in (a), a 0.5 μm layer of Al is sputtered over the surface. In a second step, illustrated in (b), a thin photoresist layer is spun onto the Al layer. In a third step, illustrated in (c), the photoresist is developed and the exposed Al is etched. In a fourth step, illustrated in (d), deep reactive ion etching is used to define the pillars, after the Al and remaining resist is stripped. In a final step, illustrated in (e), gold is sputtered (seed layer) and electroplated.

As experimental confirmation, an exemplary micromachined ridge gap waveguide and resonator for 220-325 GHz will now be discussed in more detail. As discussed in the foregoing, a ridge gap waveguide is a fundamentally new high-frequency waveguide, which does not need any electrical contact between the split blocks, and which gives it an advantage compared to the rectangular waveguide, which is the standard today. Rectangular waveguides are often fabricated by milling. However, there are issues when constructing waveguides above 100 GHz. As has already been discussed, it has now been discovered that MEMS technology can offer high-precision fabrication and thus enables the path for new types of high-frequency components.

MEMS here related to "Microelectromechanical systems" (also written as micro-electro-mechanical, MicroElectroMechanical or microelectronic and microelectromechanical systems) is the technology of very small devices; it merges at the nano-scale into nanoelectromechanical systems (NEMS) and nanotechnology. MEMS are also referred to as micromachines, or micro systems technology—MST. MEMS are typically made up of components between 1 to 100 micrometers in size (i.e. 0.001 to 0.1 mm), and MEMS devices generally range in size from 20 micrometers (20 millionths of a meter) to several millimeters (i.e. 0.02 to 10 mm).

In the example to be discussed in the following, a ridge gap waveguide and a ridge gap resonator have been fabricated for the frequencies 220-325 GHz using MEMS technology. Support packages have been designed to enable device measurements.

Figure 7A:
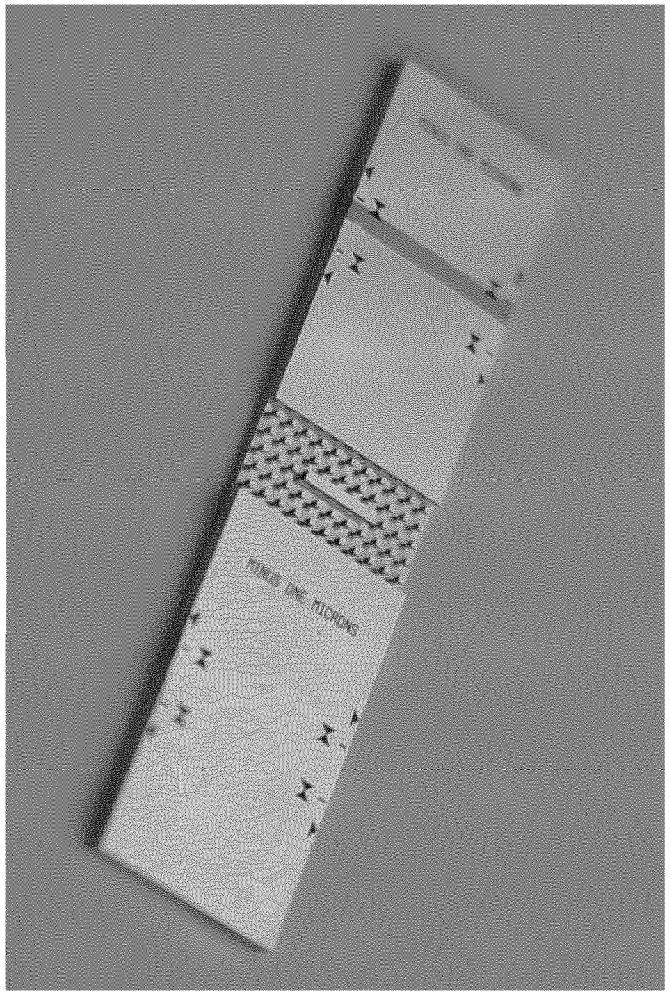
Figure 7B:
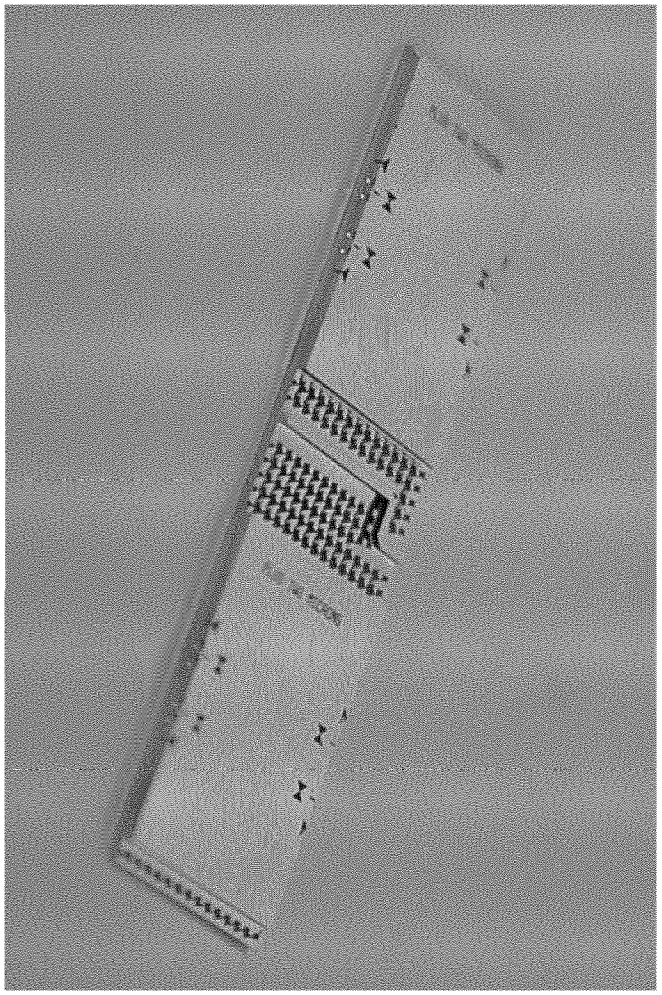

Two devices were fabricated forming a bent-line waveguide and a resonator, as shown in FIGS. 7*a* and 7*b*. The principle of the waveguide is based on having a Perfectly Electrically Conductive (PEC) surface parallel to a Perfectly Magnetically Conductive (PMC) surface with an electrically conductive ridge embedded into it. The PMC is obtained by a pin surface that forms a metamaterial, as discussed in P.-S. Kildal, E. Alfonso, A. Valero-Nogueira, and E. Rajo-Iglesias "Local metamaterial-based waveguides in gaps between parallel metal plates", IEEE Antennas and Wireless Propagation letters (AWPL), Vol. 8: pp. 84-87, 2009, said document hereby being incorporated in its entirety by reference.

The wave is prohibited from propagating away from the ridge by the pin surface. Packages were milled to support the silicon chip during measurements. The packages act as an interface and transition from the ridge gap waveguides to standard rectangular waveguides.

Figure 8:
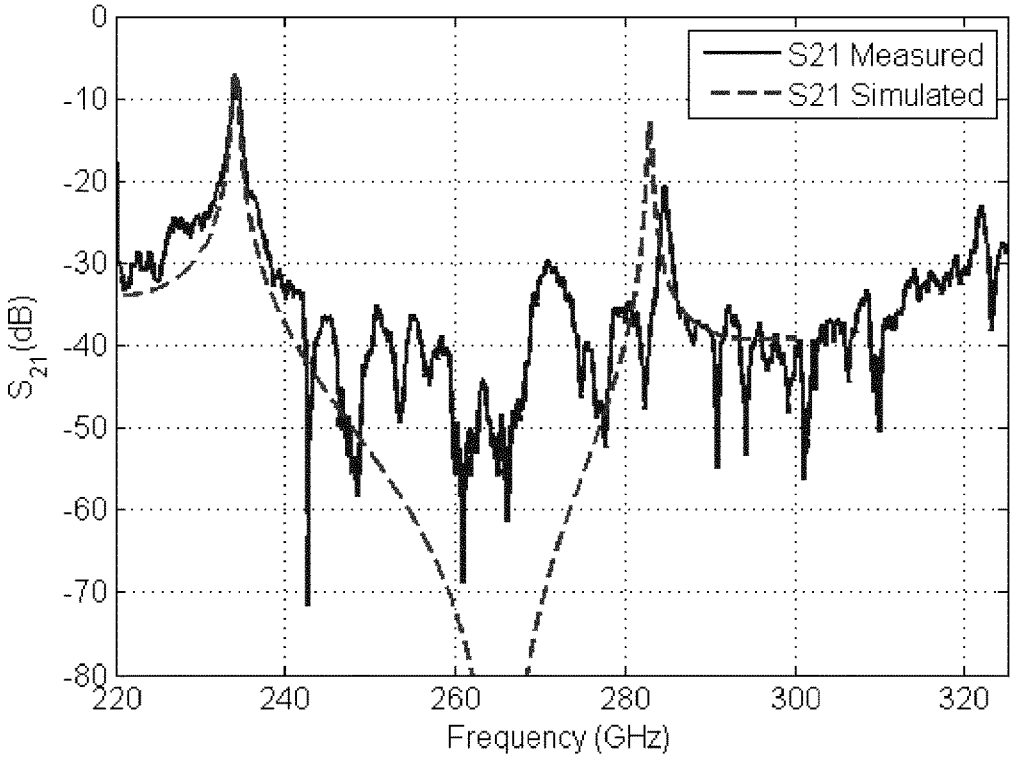
FIG. 8 is a diagram illustrating results of measurement and simulation of an exemplary resonator made in accordance with an embodiment of the present invention.

Simulations show that the reflection coefficient for the ridge gap waveguide is below −15 dB between 240 and 340 GHz. Two resonance peaks were measured, as is seen in FIG. 8, at the frequencies 234 GHz and 284 GHz for the ridge gap resonator with unloaded Q-values of 336 and 527 respectively. Both the ridge gap waveguide and resonator have the potential to obtain similar performances as the rectangular waveguide without strict requirement on electrical contact, allowing simplified fabrication and assembly technique.

Figure 9:
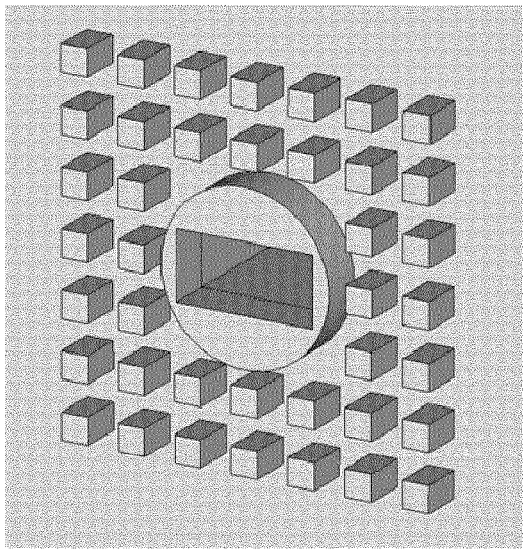
FIGS. 9 and 10 are illustrations of a contactless pin-flange adapter in accordance with an embodiment of the present invention.
Figure 10:
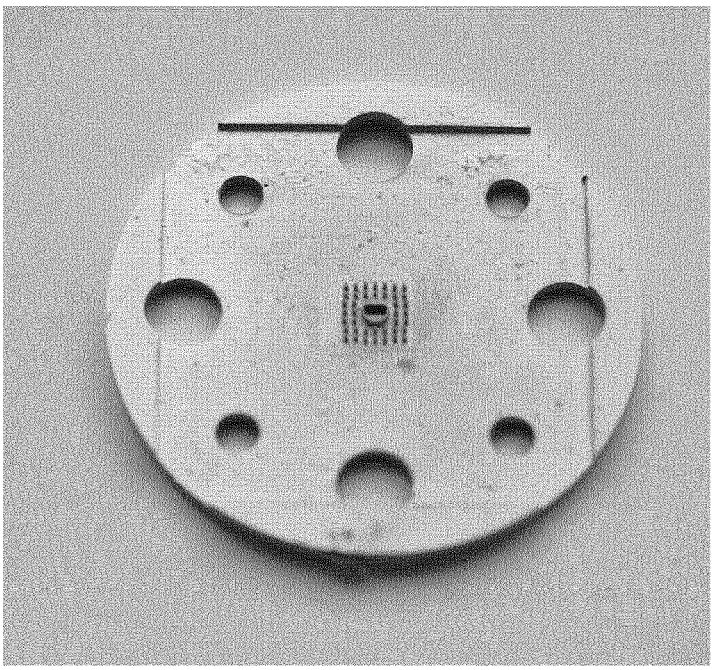

In another example, a contactless pin-flange adapter based on gap waveguide technology is considered for high-frequency measurements, as shown in FIGS. 9 and 10. Here, FIG. 9 shows a design of the pin-flange surface and FIG. 10 shows the pin-flange-adapter prototype. Conventionally standard (WR) flanges are used, these require good electrical contact and are sensitive to small gaps. The pin-flange adapter has been fabricated and demonstrated for the frequency range 220-325 GHz and does not need electrical contact and will still show similar or better results than a standard flange or a choke flange.

Figure 11:
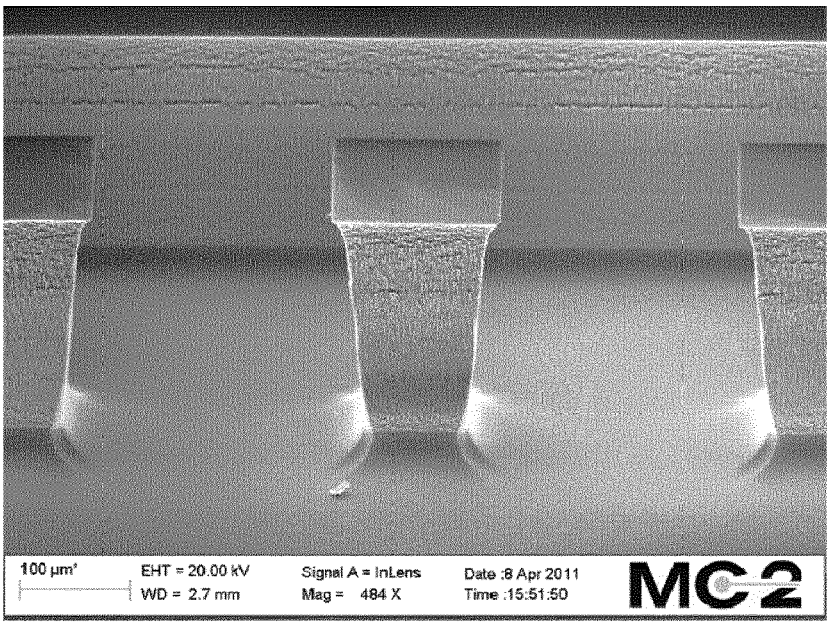
FIG. 11 is a SEM picture of micromachined pillars performed by the proposed process and formed in accordance with an embodiment of the present invention.

FIG. 11 illustrates an advantageous geometry and shape of the metamaterial, here in the form of posts/pillars, obtainable by the above-discussed methods. As is clearly seen in this SEM picture, mushroom-shapes or inverted-pyramid-shaped posts/pillars are obtained, i.e. posts/pillars having a smaller cross-sectional dimension at the end connected or integrated with the surface, and a larger cross-sectional dimension at the opposite end.

The invention is not limited to the embodiments shown here. In particular, the microwave/millimeter wave device is useable for many types of high-frequency devices, in addition to the ones discussed above. Further, different realizations of the metamaterial, such as posts, pillars, patches, nails, etc, and having different geometry, shapes etc, are feasible. Further, the metamaterial may be arranged on either one of the two surfaces, or even on both surfaces. Further, the two surfaces may be connected in various ways, and the cavity need not be closed, but may be open at one or several sides. Further, the conducting surfaces need not be mechanically fastened to each other, and also, many alternative options for mechanical interconnection, apart from the examples discussed above, are feasible. Still further, other types of MEMS and micromachining are useable to obtain similar results to the ones discussed above. Such and other related modifications should be considered to be within the scope of the patent, as it is defined in the appended claims.

The invention claimed is:

1. A scalable production method for fabrication of a microwave/millimeter wave device, said microwave/millimeter wave device operating at frequencies in the entire range of or one or more subranges of the frequency range between 1 GHz and 100 THz, and comprising the step of providing a metamaterial on a surface of said microwave/millimeter wave device, wherein the step of providing said metamaterial on said surface of the microwave/millimeter wave device involves the use of at least one polymer to fabricate a high-resolution structure, and subsequent metallization of the high-resolution structure.

2. The method of claim 1, wherein the microwave/millimeter wave device comprises two opposing surfaces of conducting material arranged to form a narrow gap there between, wherein at least one of the surfaces is provided with at least one conducting element, and wherein at least one of the surfaces is provided with said metamaterial, thereby stopping wave propagation in other directions inside the gap than along said conducting element.

3. A microwave/millimeter wave device, said microwave/millimeter wave device operating at frequencies in the entire range of or one or more subranges of the frequency range between 1 GHz and 100 THz, wherein the microwave/millimeter wave device comprises a metamaterial arranged on at least one surface thereof, said metamaterial being based on mushroom-shaped or inverted-pyramid-shaped pillars, wherein the metamaterial acts as a perfect magnetic conductor in the operating frequency range.

4. The method of claim 1, wherein the at least one polymer comprises a patterned photosensitive high-aspect ratio polymer.

5. The method of claim 1, wherein at least one of said at least one polymers is formed by at least one of: a micromolding process or hot embossing.

6. The method of claim 1, wherein the metallization is applied by at least one of sputtering, evaporation and chemical vapor deposition.

7. The method of claim 6, wherein the metallization is subsequently improved by at least one of electroplating and electroless plating.

8. The method of claim 1, wherein one fabricated part of the microwave/millimeter wave device is a lid.

9. The method of claim 1, wherein the metamaterial is formed on a flange on said microwave/millimeter wave device.

10. The method of claim 1, wherein the microwave/millimeter wave device is at least one of: a waveguide, a transmission line, a waveguide circuit, a transmission line circuit, a resonator/filter, a flange, a splitter, a shielding and a packaging.

11. The method of claim 2, wherein the at least one conducting element is selected from the group consisting of: a conducting ridge provided on the surface, a groove with conducting walls provided on the surface, and a conducting strip arranged within a multilayer structure of the surface.

12. A scalable production method for fabrication of a microwave/millimeter wave device, said microwave/millimeter wave device operating at frequencies in the entire range of or one or more subranges of the frequency range between 1 GHz and 100 THz, and comprising the step of providing a metamaterial on a surface of said microwave/millimeter wave device, wherein the step of providing said metamaterial on said surface of the microwave/millimeter wave device involves a Lithographie, Galvanoformung, Abformung (Lithography, Electroplating and Molding, LIGA) process.

13. A scalable production method for fabrication of a microwave/millimeter wave device, said microwave/millimeter wave device operating at frequencies in the entire range of or one or more subranges of the frequency range between 1 GHz and 100 THz, and comprising the step of providing a metamaterial on a surface of said microwave/millimeter wave device, wherein at least one part of said microwave/millimeter wave device is fabricated using freeforming or 3D forming in metals or other conducting material or metalized non-metals.

14. The method of claim 13, wherein the fabrication using freeforming or 3D forming in metals or other conducting material or metalized non-metals is applied by at least one of sputtering, evaporation and chemical vapor deposition.

15. The method of claim 14, wherein the fabrication using freeforming or 3D forming in metals or other conducting material or metalized non-metals is improved by electroplating or electroless plating.

16. The device of claim 3, wherein the at least one conducting element is selected from the group consisting of: a conducting ridge provided on the surface, a groove with conducting walls provided on the surface, and a conducting strip arranged within a multilayer structure of the surface.

17. The device of claim 3, wherein the microwave/millimeter wave device comprises two opposing surfaces of conducting material arranged to form a narrow gap there between, wherein at least one of the surfaces is provided with at least one conducting element, and wherein at least one of the surfaces is provided with said metamaterial, thereby stopping wave propagation in other directions inside the gap than along said conducting element.

18. The device of claim 3, wherein the metamaterial is provided on a flange of said microwave/millimeter wave device.

19. The device of claim 3, wherein the microwave/millimeter wave device is at least one of: a waveguide, a transmission line, a waveguide circuit, a transmission line circuit, a resonator/filter, a flange, a splitter, a shielding and a packaging.

20. The device of claim 3, wherein said device is produced in accordance with a scalable production method for fabrication of a microwave/millimeter wave device, comprising the step of providing the metamaterial on a surface of said microwave/millimeter wave device.

21. The method of claim 1, wherein said microwave/millimeter wave device operates in a the frequency range above 100 GHz.

* * * * *